United States Patent [19]

Beck

[11] 4,158,620

[45] Jun. 19, 1979

[54] RETORTING OIL SHALE WITH IRON OXIDE IMPREGNATED POROUS PELLETS

[75] Inventor: Steven R. Beck, Lubbock, Tex.

[73] Assignee: Atlantic Richfield Company, Los Angeles, Calif.

[21] Appl. No.: 858,576

[22] Filed: Dec. 8, 1977

[51] Int. Cl.[2] ..... C10G 1/00; C10B 49/00; C10B 49/16

[52] U.S. Cl. ..... 208/11 R; 201/10; 201/12

[58] Field of Search ..... 208/11 R; 201/10, 12

[56] References Cited

U.S. PATENT DOCUMENTS

| | | | |
|---|---|---|---|
| 2,441,386 | 5/1948 | Berg | 208/11 R |
| 2,494,695 | 1/1950 | Fisher | 201/12 X |
| 2,725,348 | 11/1955 | Martin et al. | 201/12 |
| 2,743,216 | 4/1956 | Jahnig et al. | 201/12 |
| 3,018,243 | 1/1962 | Nevens | 208/11 R |
| 3,020,209 | 2/1962 | Culbertson, Jr. et al. | 201/12 |
| 3,803,021 | 4/1974 | Abul-Rahman | 208/11 R |
| 3,844,929 | 10/1974 | Wunderlich et al. | 208/11 R |

FOREIGN PATENT DOCUMENTS

| | | | |
|---|---|---|---|
| 1019267 | 10/1977 | Canada | 201/12 |
| 184144 | 3/1923 | United Kingdom | 201/12 |
| 305106 | 1/1929 | United Kingdom | 201/12 |

*Primary Examiner*—Delbert E. Gantz
*Assistant Examiner*—William G. Wright
*Attorney, Agent, or Firm*—M. David Folzenlogen

[57] ABSTRACT

Oil shale is mixed and retorted with hot porous pellets. The porous pellets have a surface area of at least 10 square meters per gram. Iron oxide is deposited or impregnated on the pellet surface area prior to retorting. The iron oxide imparts special properties to the pellets. After retorting, the pellets are separated from the processed oil shale solids, reheated and returned to a retort. At least a portion of the pellets are separated by a magnetic separator.

3 Claims, 2 Drawing Figures

RETORTING OIL SHALE WITH IRON OXIDE IMPREGNATED POROUS PELLETS

BACKGROUND OF THE INVENTION

This invention relates to an improved oil shale retorting process and a separation system using iron oxide impregnated porous heat carriers.

U.S. Pat. No. 3,844,929 provides an oil shale retorting process using porous pellets having a surface area of at least 10 square meters per gram and a size ranging from approximately 0.04 centimeter (0.055 inch) to approximately 1.27 centimeters (0.5 inch). In this process, a combustible deposition is formed on the pellets. This deposition is burned to heat the pellets to a temperature between 538° C. (1000° F.) and 816° C. (1500° F.). The heated pellets are mixed with crushed oil shale. The heat from the pellets helps to convert the kerogen in the oil shale to oil and gas and produces a mixture of pellets and spent shale solids. The pellets are separated from the spent shale solids so that the porous pellets may be heated and recycled through the retorting process. The pellets must be separated in a dry system wherein dust and other emissions into the atmosphere are controlled. In addition, the mixture of pellets and spent shale are usually separated at relatively high temperatures, e.g., 204° C. (400° F.) to 538° C. (1000° F.). A commercial oil shale plant using porous pellets may retort as much as 50,000 metric tons (about 55,000 short tons) to 118,000 metric tons (about 130,000 short tons) of raw crushed oil shale per day with varying oil yields per ton. This will require recovery and recycle of one to three times as many tons of the heat-carrying pellets. Several methods of separating the solids have been proposed. In U.S. Pat. No. 3,803,021, a combination elutriation-size screening separating system is used to recover the heat-carrying solids. In co-pending Application Ser. No. 749,505, filed Dec. 10, 1976, now U.S. Pat. No. 4,118,309 entitled "Separation and Recovery of Heat Carriers in an Oil Shale Retorting Process", and owned by a common assignee, a continuously restored inclined surface is used for assisting in separation of heat-carrying solids from the spent shale solids. In co-pending Application Ser. No. 858,578, filed Dec. 12, 1977, entitled "Magnetic Separation of Heat Carrying Solids from Spent Oil Shale", and owned by a common assignee, a ferromagnetic material is added to the heat carriers and the solids passed through a magnetic separator. At the temperatures involved in retorting oil shale, the addition of iron into the heat carriers is likely to adversely affect the strength properties of the heat carriers. Moreover, the heat carriers may be handled in a way where residual magnetism of the iron causes handling problems.

The oil produced by retorting oil shale contains metal impurities like arsenic which poison hydrotreating catalysts and are removed prior to substantial hydrogenation of the oil.

SUMMARY OF THE INVENTION

Oil shale is retorted with hot porous pellets having a surface area of at least 10 square meters per gram. An iron oxide is impregnated or deposited on the surface area of the pellets. The iron oxide is originally predominantly comprised of two parts iron and three parts oxygen. This form of iron oxide is nonmagnetic, but at retort conditions the iron oxide changes to a magnetic form, that is, three parts iron and four parts oxygen. The changed iron oxide stays magnetic until oxidation conditions are encountered. The amount of iron oxide impregnated on the pellets is sufficient to make the magnetic attractability of the pellets significantly higher from a magnetic separator point of view than spent shale solids.

In the retort, oil and gas products are formed. The iron oxide on the porous pellets removes some of the metal impurities, for example, arsenic, from the oil vapors.

After retorting, the pellets are separated from the processed spent shale in one or more separation stages. At least one stage is a magnetic separation stage. In the magnetic separation stage, the iron oxide is still in its magnetic form. Preferably, the porous impregnated pellets will be less than about 1.27 centimeters (0.5 inch) and will have a surface area of between 10 and 150 square meters per gram.

DETAILED DESCRIPTION OF THE INVENTION

Figure 1:
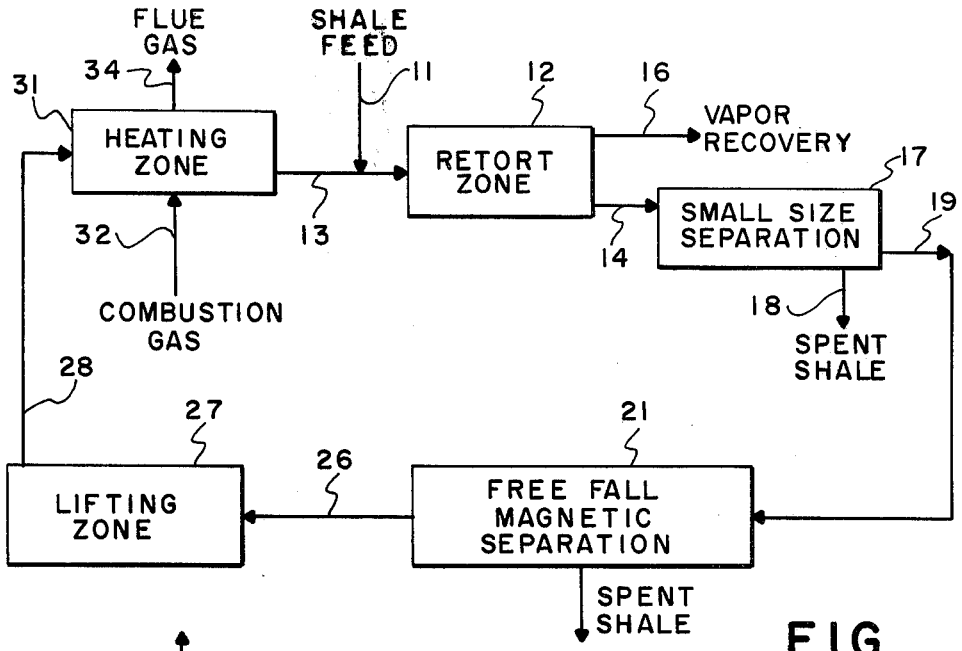
FIG. 1 is a schematic flowsheet of a porous pellet retorting process employing a magnetic separation stage.
Figure 2:
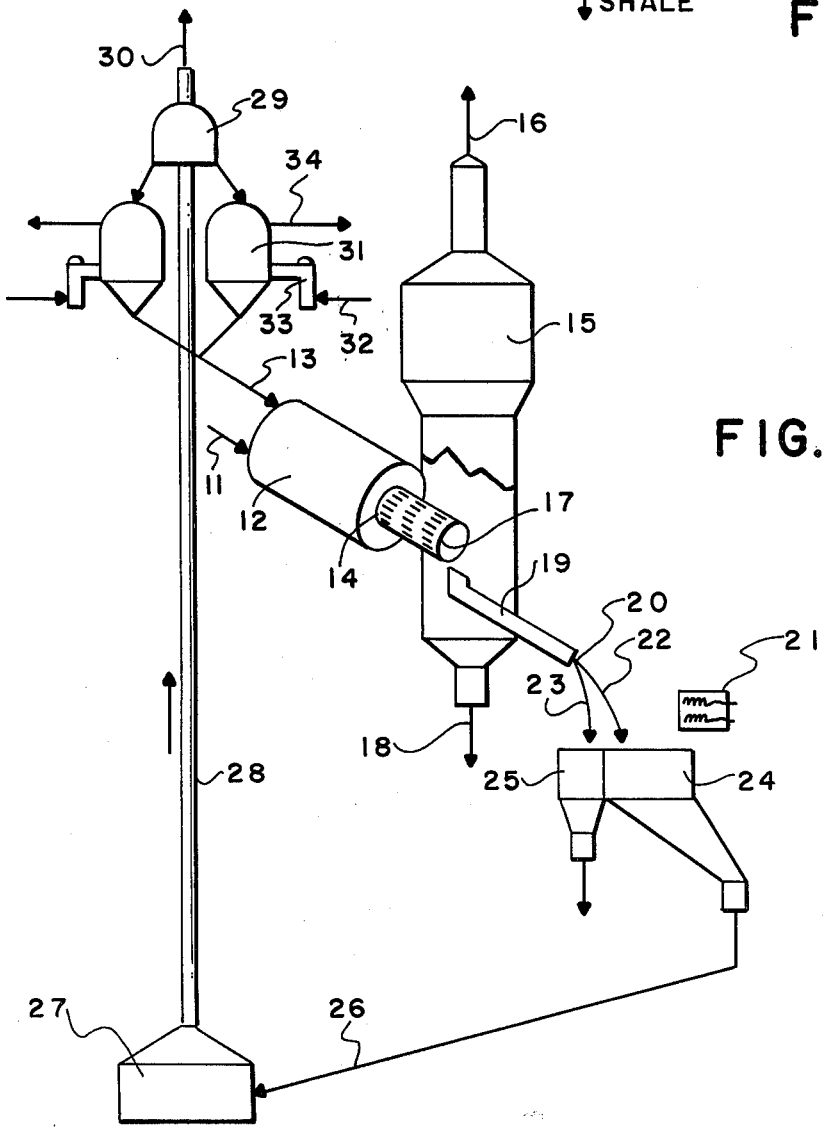
FIG. 2 is a partly schematical, partly diagrammatical flow illustration of a porous pellet retorting process using, for illustrative purposes, a falling magnetic separation stage.

In the oil shale retorting process illustrated in FIGS. 1 and 2, mined oil shale crushed by a particle diminution process to a suitable size and which may or may not have been preheated is fed by way of shale inlet line 11 to retort zone 12 where oil shale is mixed with hot heat-carrying solids. These particulate solids are fed by way of gravity or other mechanical means to the retort zone by way of heat-carrier inlet pipe 13. The shale feedstock will usually be fed by way of a metered weight controller system so that the proper ratio of heat carriers to raw shale is maintained.

For reasons hereinafter made apparent, the heat-carrying solids are made up of pellets which must be porous and have a minimum relatively high internal surface area of 10 square meters per gram. Preferably, the pellets will have a maximum average size of 1.27 centimeters (0.5 inch), that is, below about 1.27 centimeters and an average surface area of between 10 and 150 square meters per gram. The surface area is the average effective surface area of the heat carrier pellets as they enter the retort zone. The surface area may be determined by the conventional nitrogen absorption method. The pellets have a special composition. The base pellet is made up of materials, such as ceramics, alumina, or silica alumina, which are not consumed in the retorting process. They are sufficiently wear or breakage resistant and heat resistant to maintain enough of their physical characteristics under the conditions employed in the process to satisfy the requirements of the retorting process. Impregnated or deposited on the surface area of the pellets is a material originally comprised of iron oxide. The iron oxide is laid down on the pellet surface area in the same way that catalyst metals are deposited on porous carrier bases. The iron oxide is originally comprised predominantly of two parts iron and three parts oxygen, that is, $Fe_2O_3$. This iron may be readily deposited on the pellets without adverse affect to the strength of the pellets. This form of iron oxide is non-magnetic; but when the pellets are fed to a retort zone, the pellets are reduced to a magnetic form, that is, three parts oxide and four parts oxygen, $Fe_3O_4$. This iron oxide will retain its magnetic attractability until the pellets are subjected to a more oxidizing environment. The amount of iron oxide impregnated on the pellets is sufficient when changed to a magnetic form to make the magnetic attractability of the pellets significantly higher from a magnetic separator point of view than processed spent shale. This amount of iron oxide also is sufficient to provide iron oxide for removing some metal impurities, for example, arsenic, from the oil vapors formed in the retort zone.

Retort zone 12 is any sort of retort wherein the crushed oil shale feedstock and hot heat carriers are intimately mixed. The retort zone illustrated in FIG. 2 is an inclined retorting drum that causes the oil shale and heat carriers to undergo a sort of tumbling action. This sort of retort is herein referred to as a rotating retort zone. This type of retort zone is flexible over a wide range of process conditions and is especially suited to retorting with hot, porous heat-carrying solids of the type heretofore described. This type of retort zone causes rapid solid-to-shale heat exchange which in turn causes flashing and pyrolysis of the kerogen in the oil shale to gas and oil vapors. This is particularly useful in the process of this invention because the iron oxide on the pellets removes metal impurities, e.g., arsenic, from the oil vapors.

This sort of rotating retort also causes the solids to move through the retort in a manner which eventually aids separation of the pellets from the spent mineral matter in the oil shale. The rotating retort zone also facilitates formation of a more uniform controlled amount of combustible carbon-containing deposition on the internal surface area of the pellets.

The hot heat-carrying pellets are fed to the retort zone at a temperature ranging between 538° C. (1000° F.) and 816° C. (1500° F.) which is significantly higher than the designed retort temperature within the retort zone. The quantity of hot heat-carrying pellets is controlled so that the heat carrier-to-shale feedstock ratio on a weight basis is such that the sensible heat in the heat carriers is sufficient to provide a significant portion (for example, at least fifty percent) of the heat required to heat the shale feedstock from its retort zone feed temperature to the designed retort temperature. The feedstock feed temperature is the temperature of the oil shale after preheating, that is, the temperature of the shale upon entry into the retort zone. The average retort temperature ranges between about 454° C. (850° F.) and about 649° C. (1200° F.), depending on the nature of the shale feedstock, the ratio of heat carriers or pellets to oil shale, the product distribution produced in the retort zone, heat losses and the like. The preferred range of pellet-to-shale feedstock ratio is between 1 and 3 on a weight basis.

The pellets act both as a heat carrier and as a fuel carrier. In the retort zone, a combustible carbon-containing deposition or residue is formed or deposited on the relatively high internal surface area of the porous pellets. The amount of combustible deposition formed or deposited on the pellets upon one passage through the process is sufficient upon combustion to provide at least fifty percent of the heat required to reheat the pellets. The amount of combustible deposition deposited during the retorting stage is on an average less than 1.5 percent by weight of the pellets, for example, 0.8 to 1.5 percent by weight. The pellet surface area, size, and amount coact with the iron oxide deposition and with other retort process conditions to accomplish the desired reactions, magnetic attractability, amount of combustible deposition, and petroleum product distribution. If the surface area of the pellets is less than 10 square meters per gram, it is unlikely that a durable and sufficient amount of iron oxide will be impregnated on the pellets and that enough total combustible deposition will be formed or the burning of the deposition will be sufficient to provide a major portion of the heat required to heat the pellets to the desired temperature and to carry out the retorting phase of the retorting process.

Returning now to FIGS. 1 and 2, it will be noted that the oil shale feedstock and the hot heat-carrying pellets move concurrently through retort zone 12. In the retort zone, the hotter pellets admix with the cooler crushed shale feedstock upon their being charged into the retort zone. The shale particles are rapidly heated by sensible heat transfer from the heat-carrying pellets to the shale. As a result, water in the shale is vaporized and kerogen or carbonaceous matter in the shale is decomposed, vaporized, and cracked into gaseous and condensible oil fractions, thereby forming a valuable vaporous effluent including gas, oil vapors, and super heated steam. At the same time, the iron oxide is changed to a magnetic form and the iron oxide reduces metal impurities like arsenic in the oil vapors.

Pyrolysis and vaporization of the carbonaceous matter in the oil shale leaves irregularly-shaped, laminar-like particulate spent shale solids in the form of the spent mineral matrix matter of the oil shale and a relatively small amount of unvaporized or coked organic carbon-containing material. In a typical retort system, there will be approximately one metric ton of spent shale for every one to three metric tons of spherically-shaped heat carriers. The irregularly-shaped spent shale solids and the pellets are intimately mixed and form a mixture of solids which needs to be separated so that the pellets may be reheated and returned to the retort zone. As previously mentioned, a combustible carbon-containing deposition or residue is formed or deposited on the pellets during the retort phase of the process.

The mixture of spherically-shaped solids and shale moves through the retort zone toward retort exit 14 and the gaseous and vaporous effluents containing the valuable hydrocarbon materials separates from the mixture. The residence time of the shale in the retort zone will depend upon the system and the flow or movement characteristics of the mixture. Shale residence times vary, but they are usually on the order of about three to about twenty minutes.

The mixture of spherically-shaped heat carriers and irregularly-shaped spent shale exits from retort zone 13 by way of retort exit 14 into recovery chamber 15 where the gaseous and vaporous products are collected overhead and passed to overhead retort products line 16. The product vapors exit the retort zone at a temperature which depends upon the process and which usually lies between 400° C. (750° F.) and 621° C. (1117° F.). The product vapors are usually subjected to hot dust separation and the dust thus separated is collected and may be combined and handled with other spent shale for proper disposal.

The mixture of spherically-shaped solids and irregularly-shaped spent shale exits the retort zone at a temperature which also depends upon the process, but which usually lies within the aforementioned temperature range for the vaporous products. The mixture of particulate solids from the retort zone is then passed through a separation and recovery system wherein at least 80 percent by weight of the pellets in a significant size range are recovered for recycle to a retort zone. At the same time, at least 75 percent by weight of the spent shale in solids mixture from the retort zone is separated in the separation stages of the process from the mixture and disposed. The separated spent shale may be disposed as waste or used for some other purpose.

The separation and recovery system for handling the solids mixture will include one or more stages. In any event, at least a portion of the solids mixture will pass through a magnetic separation stage before the iron oxides on the pellets is oxidized to a nonmagnetic state. This is illustrated in the drawings wherein the mixture of solids exiting the retort zone through retort exit 14 are passed through a first separation stage represented by revolving screen or trommel 17 extending into product recovery chamber 15. In this first separation stage, spent shale particles smaller than the pellets, for example, 0.14 centimeter (0.055 inch), are at least partially removed from the mixture. As shown, this is accomplished by openings or apertures sized to pass the spent shale solids that are smaller than the pellets and to screen out the smaller size spent shale solids. Most of the smaller spent shale solids flow through trommel 17 and drop to the bottom of recovery chamber 15 to exit via exit line 18. As shown, spent shale and pellets too large to pass through the openings in the trommel pass outward through exit 19 for further separation. This prescreening or initial first separation stage of the smaller spent shale is optional. It easily reduces the amount of solids to be handled in later stages.

As shown, the spent shale solids and heat-carrying pellets remaining after the first separation stage pass through exit line 19 at a relatively high temperature, for example, between 400° C. (750° F.) and 621° C. (1117° F.) where the mixture of pellets and spent shale solids are passed through a suitable magnetic separation stage. For illustrative purposes, the magnetic separation stage described in co-pending Application Ser. No. 858,578, filed Dec. 12, 1977, entitled "Magnetically Separating Falling Heat Carriers", which was filed by the same inventor as this application and which is owned by a common assignee, is used herein. In this sort of separation stage, pellets and spent shale solids are caused to fall in a free falling stream 20. The free falling stream of solids is subjected to a magnetic field which is established by electromagnet 21. The magnetic source is located laterally of the falling stream of solids so that the magnetic field exerts a lateral attractive force on the falling pellets which are magnetically attracted because of the magnetic iron oxide on the pellets. The magnetic force is in a cross-flow direction to the falling solids. The magnetic field or force is of sufficient strength to cause the falling pellets to follow a deflected or curved path toward electromagnet 21. The magnetic source has little effect on the free falling spent shale solids which are relatively nonmagnetic. The magnetic field thereby causes the falling first stream to split into two falling streams. One stream follows a path represented by heat carrier path 22. The other system follows a path represented by spent shale path 23. The pellets, therefore, fall in a path closer to the magnetic source than the path of the spent shale solids. This relative lateral movement of the magnetically attracted pellets allows a stream enriched in pellets to be separately collected in receptacle 24 and the nonmagnetic spent shale solids in a stream enriched in shale solids to be separately collected in receptacle 25.

The pellets in receptacle 24 are passed through pellet return line 26 to lift system 27 to be recycled back to heating zone to be reheated. The pellets are lifted to a heating zone which is close to the retort zone so that the hot heat carriers may be fed to the retort zone without a significant loss of heat. The pellets may be lifted by gas, ball elevator, conveyor belt, or the like.

As shown in FIG. 2, lift system 27 for the pellets is a gas system where the pellets collected from the separation system are gas lifted through lift line 28 to surge hopper 29 for collecting the pellets which bear a combustible fuel deposition. The gas used to lift the pellets will usually be a noncombustion supporting gas. The lift gas exits by way of exit line 30.

The pellets are fed by gravity or other suitable means to heating zone 31 which may be any suitable heating zone for reheating the pellets to the desired temperature, that is, a temperature which enables the pellets to be fed to the retort at a temperature ranging between 538° C. and 816° C.

In FIG. 2, heating zone 31 is a pellet deposition burning zone. As previously mentioned, the pellets bear a combustible deposition which was absorbed or deposited during the retorting stage of the process. This combustible deposition is burned in heating zone 31 to provide at least 50 percent or more of the heat required to reheat the pellets to the temperature required to effect retorting of the oil shale. The combustible deposition is burned in a manner similar to the way that cracking catalyst particles are regenerated. A combustion supporting gas, for example, air, a mixture of air and fuel gas generated in the process, or flue gas with the desired amount of free oxygen, is blown into the deposition burning-heating zone at a temperature at which the deposition on the porous pellets is ignited by way of combustion gas inlet 32. Steam may also be used to control burning, provided that the steam does not excessively reduce the surface area of the porous solids. The combustion supporting gas may be preheated in heaters 33 by burning some of the gases produced in the process to reheat the porous pellets to the minimum ignition temperature. The quantity of combustion supporting gas, for example, about 4.5 kilograms (10 lbs.) to about 6.8 kilograms (15 lbs.) of air per 0.45 kilograms (1 lb.) of deposition affects the total amount of deposition burned and the heat generated by such burning and, in turn, the temperature of the pellets. Generally, it is not desirable to attempt to free the pellets of deposition. Some factors taken into consideration during burning of the deposition are the porosity, density, and size of the pellets, the burner chamber size and bed size, residence burning time, the desired temperature for the heat carriers, heat losses and inputs, the heat carrier and oil shale feed rates to the retort zone, dust content, and the like. The residence burning time will usually be rather long and up to about 30 to 60 minutes. Combustion of the deposition should be controlled in a manner which does not heat the porous pellets to above 816° C. (1500° F.). The hot flue gases generated in the deposition burning zone may be removed by exit line 34 and used to preheat cool raw shale feedstock or for heat transfer in some other part of the oil shale facility. Of course, additional fuel material or gases may be used to supplement the burning of the deposition on the porous pellets if this is necessary.

Reheating of the pellets produces a continuous stream of hot pellets in the desired temperature range for recycle by way of retort inlet line 13 either by gravity and/or mechanical means to retort zone 12. The rate of passage of the reheated heat carrying solids from the reheating zone will be metered or controlled in a conventional manner to eventually provide the optimum heat carrier-to-oil shale feedstock ratio in the retort zone.

The foregoing description of this invention describes an improvement in oil shale retorting processes wherein iron oxide impregnated pellets are used to retort oil shale. Reasonable variations and modifications are practical within the scope of this disclosure without departing from the spirit and scope of the claims of this invention. For example, any suitable forms of magnetic separators may be used.

The embodiments of the invention in which an exclusive property or privilege is claimed are defined as follows:

1. In a method for retorting crushed oil shale containing carbonaceous organic matter and mineral matter wherein hot heat-carrying solids at retort zone inlet temperature are mixed with oil shale in a retort zone to produce gas and oil products and a mixture of said heat-carrying solids and spent shale solids and wherein heat-carrying solids are separated from spent shale solids in at least one separation stage, the improvement comprising:

a. feeding crushed oil shale and hot porous pellets to a retort zone, said hot porous pellets being at a retort zone inlet temperature of between 538° C. and 816° C. and in a quantity such that the sensible heat in said pellets is sufficient to provide at least fifty percent of the heat required to heat said crushed oil shale from its retort zone feed temperature to a retort zone outlet temperature of between 400° C. and 621° C., said pellets having a surface area of at least 10 square meters per gram, said pellets having an iron oxide material impregnated on said surface area, said iron oxide being originally comprised predominantly of two parts iron and three parts oxygen, said iron oxide being in sufficient quantity to make the magnetic attractability of said pellets significantly higher than the magnetic attractability of said spent shale solids at the operating conditions of said at least one separation stage;

b. retorting in said retort zone gas and oil products from said crushed oil shale, thereby forming a mixture of hot porous pellets and spent shale solids;

c. recovering said gas and oil products generated by retorting said crushed oil shale;

d. passing said mixture of said porous pellets and spent shale solids from said retort zone to a solids separation and recovery zone;

e. passing a mixture of said pellets and spent shale solids in said separation zone through said at least one separation stage, said separation stage being a magnetic separator; and f. separating in said magnetic separation stage at least a portion of said pellets from said spent shale solids.

2. The method according to claim 1 wherein the porous pellets have an average size less than about 1.27 centimeters and have a surface area of between 10 and 150 square meters per gram.

3. The method according to claim 1 wherein in the at least one magnetic separation stage, the iron oxide is comprised predominantly of three parts iron and four parts oxygen.

* * * * *